US006288350B1

(12) United States Patent
Campbell et al.

(10) Patent No.: US 6,288,350 B1
(45) **Date of Patent: *Sep. 11, 2001**

(54) LOCKOUT MECHANISM FOR POWER TOOL

(75) Inventors: David C. Campbell, Bel Air; Lynn E. Lentino, Westminster; Gregory S. Snider, Bel Air; Harry R. Hall, White Marsh, all of MD (US)

(73) Assignee: Black & Decker, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/617,306

(22) Filed: Jul. 17, 2000

Related U.S. Application Data

(63) Continuation of application No. 09/134,321, filed on Aug. 14, 1998, now Pat. No. 6,091,035.

(51) Int. Cl.[7] ..... H01H 9/20
(52) U.S. Cl. ..... 200/321; 200/43.17
(58) Field of Search ..... 30/276, 286, 382, 30/390, 391, 381, 475–477, 383; 74/61, 387; 83/397, 478, 860, 581, 471.3, 477.1; 92/150; 200/43.01, 43.11, 43.13, 50.01, 43.16–43.19, 50.02, 50.11, 318, 318.1, 321, 322, 332.2, 334, 522, 327, 43.21

(56) References Cited

U.S. PATENT DOCUMENTS

| | | | | |
|---|---|---|---|---|
| Re. 30,270 | | 5/1980 | Piber | 200/157 |
| 1,929,662 | | 10/1933 | Wappat | 200/157 |
| 3,331,406 | | 7/1967 | Christophel | 143/6 |
| 3,376,402 | | 4/1968 | Bednarski | 200/1 V |
| 3,383,943 | | 5/1968 | Piber | 74/529 |
| 3,461,556 | * | 8/1969 | Chambers | 30/272 |
| 3,579,002 | | 5/1971 | Wickham | 310/50 |
| 3,626,118 | | 12/1971 | Botefuhr | 200/42 R |
| 3,746,815 | | 7/1973 | Drummer | 200/157 |
| 3,780,246 | | 12/1973 | Beckering et al. | 200/157 |
| 3,873,796 | | 3/1975 | Worobec, Jr. | 200/157 |
| 3,922,785 | | 12/1975 | Fushiya | 30/391 |
| 3,952,239 | | 4/1976 | Owings et al. | 320/2 |

(List continued on next page.)

FOREIGN PATENT DOCUMENTS

| | | | |
|---|---|---|---|
| 73 21 450 | 9/1973 | (DE) | H01H/3/20 |
| 22 54 554 B2 | 5/1974 | (DE) | H01H/3/20 |
| 30 07 304 C2 | 9/1981 | (DE) | H01H/3/20 |
| 31 04 733 C3 | 8/1982 | (DE) | H01H/9/20 |
| 89 08 924 | 10/1989 | (DE) | H01H/3/20 |
| 40 12 697 C2 | 10/1990 | (DE) | H01H/3/20 |
| 40 23 101 C2 | 1/1992 | (DE) | H01H/3/00 |
| 43 09 033 A1 | 9/1994 | (DE) | H01H/9/20 |
| 196 44 285 A1 | 4/1997 | (DE) | H01H/23/16 |
| 197 07 215 A1 | 9/1997 | (DE) | H01H/3/20 |
| 197 45 100 A1 | 4/1998 | (DE) | H01H/9/20 |
| 777 244 A2 | 6/1997 | (EP) | H01H/3/20 |

*Primary Examiner*—Michael Friedhofer
(74) *Attorney, Agent, or Firm*—Shook, Hardy & Bacon LLP

(57) ABSTRACT

A switch lockout mechanism for a power tool includes a handle housing for gripping by a power tool operator. The handle housing is generally elongated in a direction corresponding to the gripping axis of a power tool operator. A switch is attached to the housing and is actuatable between an "on" position and an "off" position. A locking member is rotatably or pivotally attached to the housing. The locking member is rotatable about an axis that generally extends in the same direction as the handle housing in an elongated direction. The locking member has a first rotatable position wherein the switch is locked in its "off" position, and a second rotatable position wherein the switch is actuated to its "on" position. An actuating member allows a tool operator to move the locking member between its first and second positions.

2 Claims, 2 Drawing Sheets

U.S. PATENT DOCUMENTS

| | | | |
|---|---|---|---|
| 3,971,906 | 7/1976 | Sahrbacker | 200/157 |
| 3,973,179 | 8/1976 | Weber et al. | 320/2 |
| 4,122,320 | 10/1978 | Edgell et al. | 200/157 |
| 4,180,716 | 12/1979 | Suzuki | 200/320 |
| 4,276,459 | 6/1981 | Willett et al. | 200/157 |
| 4,277,666 | 7/1981 | Vignaud | 200/328 |
| 4,588,910 | 5/1986 | Bausch | 310/50 |
| 4,864,083 | 9/1989 | Bittel | 200/1 V |
| 4,900,881 | 2/1990 | Fisher | 200/61.85 |
| 4,934,494 | 6/1990 | Fushiya et al. | 192/0.034 |
| 5,005,295 | 4/1991 | Fushiya | 30/390 |
| 5,094,000 | 3/1992 | Becht et al. | 30/475 |
| 5,233,945 | 8/1993 | Wolf et al. | 123/41.7 |
| 5,310,259 | 5/1994 | Wanat | 366/349 |
| 5,440,089 | 8/1995 | Prokop | 200/321 |
| 5,483,727 | 1/1996 | Chang | 16/110 R |
| 5,570,512 | 11/1996 | Hoppner | 30/383 |
| 5,570,776 | 11/1996 | Buchholz et al. | 200/43.17 |
| 5,577,600 | 11/1996 | Schoene et al. | 200/43.17 |
| 5,638,945 | 6/1997 | Fukinuki et al. | 200/43.17 |
| 5,681,214 | 10/1997 | Kleider et al. | 451/358 |
| 5,778,747 | 7/1998 | Chen | 83/471.3 |
| 5,969,312 | 10/1999 | Svetlik et al. | 200/61.85 |
| 6,057,518 * | 5/2000 | Bascom et al. | 200/43.17 |
| 6,091,035 * | 7/2000 | Campbell et al. | 200/321 |

* cited by examiner

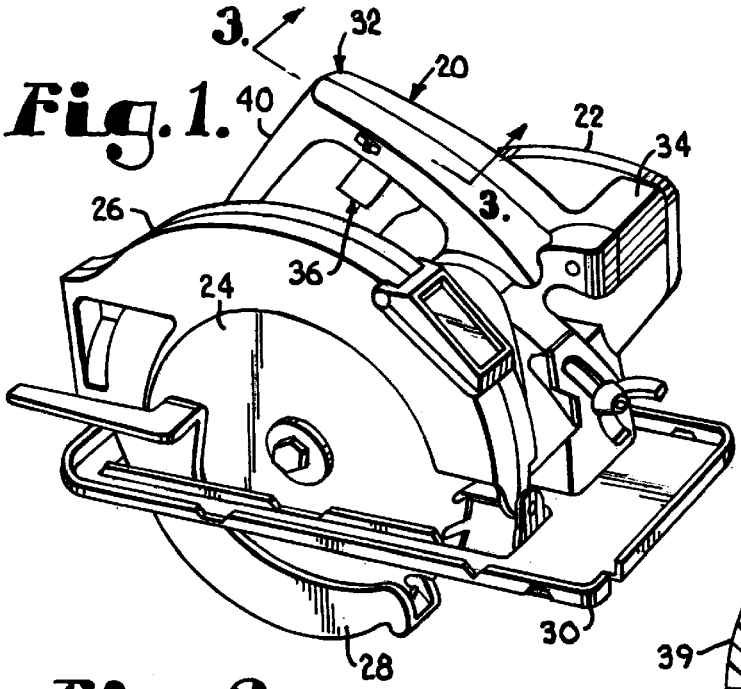
Fig. 1.
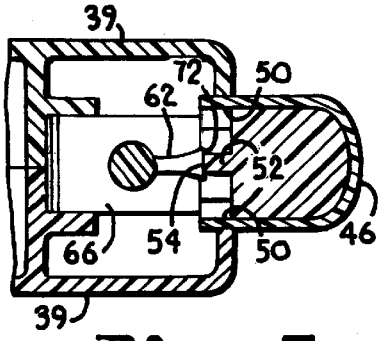
Fig. 5.
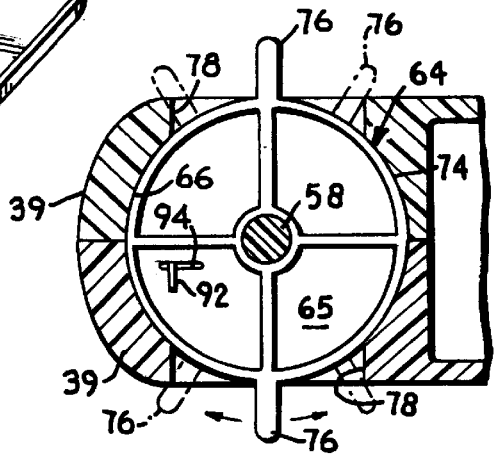
Fig. 4.
Fig. 3.
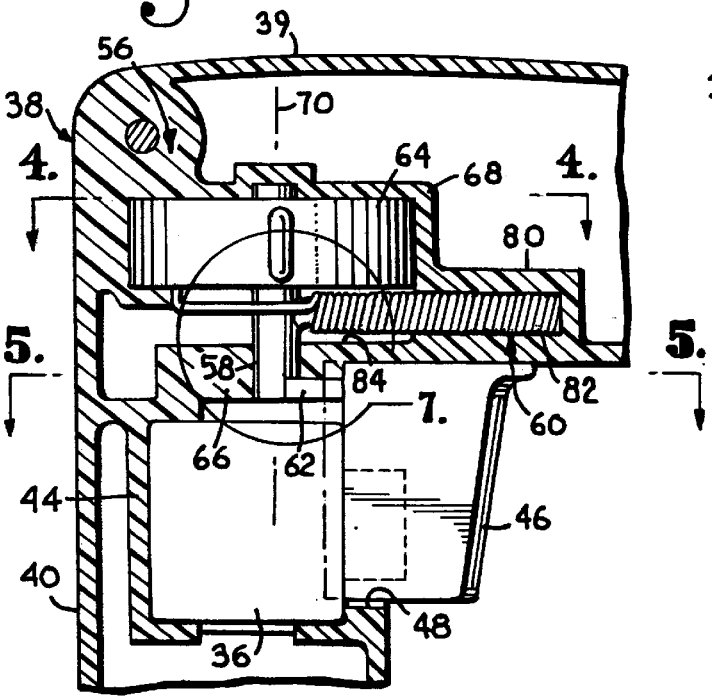
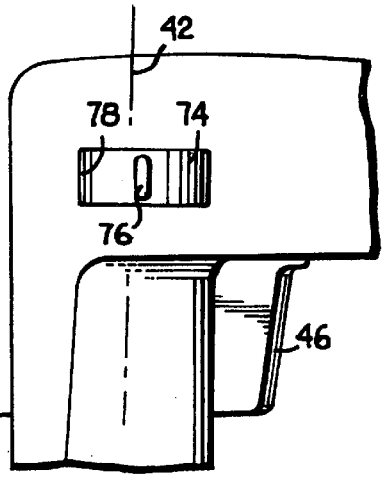
Fig. 2.

LOCKOUT MECHANISM FOR POWER TOOL

CROSS REFERENCE TO RELATED APPLICATIONS

This application is a continuation of Ser. No. 09/134,321, filed Aug. 14, 1998, now U.S. Pat. No. 6,091,035, entitled "Lockout Mechanism for Power Tool" by the same inventors.

STATEMENT REGARDING FEDERALLY-SPONSORED RESEARCH OR DEVELOPMENT

Not applicable.

FIELD OF INVENTION

This invention relates to a switch lockout mechanism for a power tool, and, more particularly, to a mechanism that locks the power switch in an "off" position and requires an operator to actuate a separate lever to orient the switch to its "on" position.

BACKGROUND OF THE INVENTION

Power tools, such as circular saws, typically have a handle molded into the body of the tool. Such a handle is grasped by the power tool operator to guide and propel the tool through the workpiece. Usually, in a circular saw there is a rear handle and a forward handle. The rear handle oftentimes resembles a pistol-type grip. The handle extends upwardly and forwardly and is separated from the body of the saw so that the operator can easily grasp an elongated handle section that fits easily within the hand of the operator. This handle section typically extends in a direction that is generally parallel to and along the line of travel of the saw. As is apparent, it is extremely desirable to have the on/off switch for the saw located so that it can be actuated by at least the index and middle fingers of the operator's hand engaging the handle. Such an arrangement allows an operator to selectively start and stop the cutting operation of the saw while having his/her hand gripping the handle.

Many prior power tool constructions have a lockout mechanism also associated with the handle structure which holds the switch on the handle in a locked position and requires the operator to actuate the mechanism prior to turning the power tool to the "on" position utilizing the switch. In particular, many of these prior structures require an operator to actuate a separate button or lever with his/her thumb prior to or simultaneously with actuation of the switch by the index and middle finger of the operator's hand gripping the handle.

Prior lockout mechanisms or latches typically are of two main types, a pivoting type and a sliding type. In a pivot type arrangement, the latch is pivotally mounted within the handle structure about an axis which is transverse or perpendicular to the elongated direction of the handle. In the case of a circular saw, the latch is pivotally mounted about an axis that is parallel to the axis of rotation of the saw blade. These latches operate by pivoting between an engaged position wherein the handle switch contacts the latch member and is prevented from movement to its "on" position, and a disengaged position wherein the operator is allowed to actuate the switch to the "on" position. Examples of these transverse pivotal lockout mechanisms can be found in U.S. Pat. Nos. 3,873,796 and 5,577,600. In each of these references, the latch mechanism is actuated by a button located on the top surface of the handle. In particular, they require either the pushing of the button or the rotating of the button rearwardly to allow actuation of the switch. These structures are disadvantageous for various reasons. In particular, the location of the lockout mechanism button on the top surface of the handle requires the positioning of the thumb in an awkward position. More specifically, it is natural when gripping a handle for the thumb to be along the side of the handle with the cross section of the handle received between the thumb and index finger. As is apparent, to actuate the mechanisms in these references, the thumb must first be positioned on the top of the handle, thus resulting in a less secure grip on the handle. Such loose gripping can result in misalignment of the saw during its initial cutting actions. Still further, in these prior references, for the thumb to reach the normal gripping position on the side of the handle, the thumb must slide off the button and over the side of the handle. The friction associated with the thumb passing over the top of the handle and the awkward sideward movement of the thumb can result in operator discomfort during the initial cutting action of the saw.

A still further disadvantage of these references is the location of the lockout mechanism actuating button above or behind the on/off switch with respect to the longitudinal axis of the handle. More specifically, when a person typically grabs a handle, the tendency is for the thumb to be forward of the index and middle fingers. To actuate the lockout mechanism buttons of these references, the thumb must be moved rearwardly to push the actuating button, thus presenting a potential awkward position for the saw operator, and, further, possibly resulting in unnecessary reorientation of the thumb along the side of the handle to the normal gripping position.

The second type of lockout mechanism includes a latch member which, when actuated, slides within the handle housing to allow actuation of the on/off switch by the operator. An example of this type of sliding latch member is disclosed in U.S. Pat. No. 5,638,945. These sliding lockout mechanisms are oftentimes relatively complicated and do not allow ergonomic positioning of the thumb during the beginning power tool operation. More specifically, the structure of the above reference, again, has the actuating switch positioned on the top surface of a handle housing and at a location that is above the actuating switch for the power tool. Thus, an operator, to operate the power tool, is required to position his or her thumb on the top of the handle instead of along the side, and to push the lockout mechanism button forward on the upper surface while pushing upward on the switch, and thereafter to slide the thumb of the hand positioned on the handle to the side of the handle to the normal comfortable gripping position. As with the pivoting latch mechanisms discussed above, this sliding-type mechanism is highly disadvantageous because it requires the operator to utilize significant effort to reposition his or her thumb in a normal gripping operation, and also has the sliding actuating switch or button located directly above the on/off switch which is typically not a normal position for a hand gripping the handle.

A still further disadvantage of all the above lockout mechanisms is the structure used to bias the lockout mechanism back to its original locked position. In particular, the prior mechanisms tend to utilize leaf springs or deformable arms to supply the biasing force. These types of biasing structures are disadvantageous because the spring force of the structure increases generally from zero along a generally linear type path with further deformation of the spring or arm. In other words, as these springs become more deformed, they offer more resistance. As is apparent, this is disadvantageous to an operator because his/her thumb must increase force with further actuation of the lockout button or lever, thus again causing more uncertainty, and less stability during initial cutting operations. Some prior art structures also utilize coil springs compressed along their central axis. These coil springs compressed in this way also have a generally linear spring force curve and are disadvantageous for the same reasons as the other biasing structures.

Therefore, a lockout mechanism is needed which will overcome the problems with the prior art lockout mechanisms discussed above.

SUMMARY OF THE INVENTION

Accordingly, it is an object of the present invention to provide a lockout mechanism which can be easily accessed by the thumb of a power tool operator at a location which allows the operator to obtain a normal gripping position as soon as possible after actuating the mechanism.

Another object of the present invention is to provide a lockout mechanism for a power tool wherein an advantageous lockout mechanism actuating lever is accessible equally to both left-handed and right-handed power tool operators.

A still further object of the present invention is to provide a lockout mechanism for a power tool, wherein the actuating lever allows an operator's thumb to slide easily and quickly to a normal gripping orientation about the power tool handle.

A further object of the present invention is to provide a lockout mechanism for a power tool, wherein the actuating lever of the lockout mechanism is located at a more natural longitudinal location on the handle with respect to the on/off switch of the power tool so as to allow easier operation.

Yet another object of the present invention is to provide a lockout mechanism of a power tool that is easily assembled and has a minimum number of parts.

A still further object of the present invention is to provide a lockout mechanism utilizing a spring member that does not require precompressing or stretching during the assembly of the lockout mechanism.

Another object of the present invention is to provide a lockout mechanism utilizing a spring member that subjects an operator's thumb to generally consistent force during operation.

Accordingly, the present invention provides for a switch lockout mechanism for a power tool, including a handle housing, for gripping by a power tool operator. The handle housing is generally elongated in a direction corresponding to the gripping axis of a power tool operator's hand. A switch is disposed in the housing and is actuatable between an "on" position and an "off" position. A locking member is rotatably attached to the housing. The locking member is rotatable about an axis that generally extends in the same direction as the handle housing's elongated direction. The locking member has a first rotatable position wherein the switch is locked in its "off" position, and a second rotatable position wherein said switch is actuated to its "on" position. An actuating member is coupled to the locking member and allows the power tool operator to move the locking member between the first and second rotatable positions.

The invention further includes a lockout mechanism for a power tool wherein the locking member has a third rotatable position that is in a rotational direction opposite to the direction that said locking member is rotated in from its first position to its second position. The third position also allows the switch to be actuated to its "on" position.

The present invention is further directed to the structure as described above, including a biasing element for urging the locking member toward its first rotatable position from both the second and third rotatable positions.

Additional objects, advantages and novel features of the invention will be set forth in part in a description which follows, and in part will become apparent to those skilled in the art upon examination of the following, or may be learned by practice of the invention.

BRIEF DESCRIPTION OF THE DRAWINGS

In the accompanying drawings which form a part of this specification and are to be read in conjunction therewith and in which like reference numerals are used to indicate like parts in the various views:

FIG. 1 is a top perspective view of a circular saw with a lockout mechanism embodying the principles of this invention;

FIG. 2 is an enlarged, side elevational view of the lockout mechanism shown in FIG. 1 positioned in the handle housing of the circular saw;

FIG. 3 is a cross-sectional view taken generally along line 3—3 of FIG. 1 and showing the structure of the lockout mechanism and switch with the lockout mechanism in its locked position which prevents actuation of the power switch to its "on" position;

FIG. 4 is a cross-sectional view taken generally along line 4—4 of FIG. 3 and showing the opposing actuating levers of the lockout mechanism, the levers in their "locked" position shown in solid lines, and the levers in the various unlocked positions shown in phantom lines and the rotation indicated by arrows;

FIG. 5 is a cross-sectional view taken generally along line 5—5 of FIG. 3 and showing the lockout mechanism in its locked position wherein the locking fin of the lockout mechanism engages an abutment projection on the power switch;

DETAILED DESCRIPTION OF THE PREFERRED EMBODIMENTS

Figure 7:
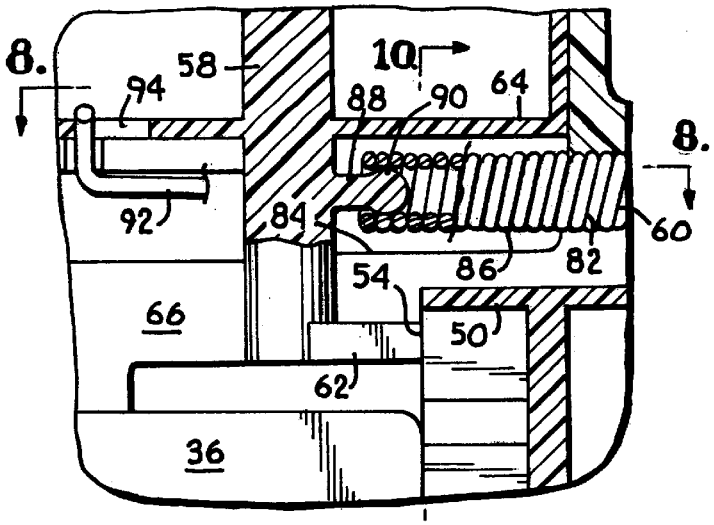
FIG. 7 is an enlarged view of the area designated by the numeral "7" in FIG. 3, with parts broken away and shown in cross section to reveal details of construction, and showing the biasing coil spring of the present invention and its attachment to the lockout shaft.

Referring to the drawings in greater detail, and initially to FIGS. 1 and 2, a power circular saw designated generally by the numeral 20 is shown. Saw 20 has a housing assembly 22 in which is disposed a motor for powering ablade 24. Blade 24 is generally surrounded by an upper stationary guard 26 and a lower movable guard 28. Saw 20 also has a generally planar base or shoe 30 attached to stationary guard 26. Base 30 rests on the upper surface of the workpiece as the saw passes therethrough and is used to gauge the depth to which blade 24 cuts.

Saw 20 further includes a rear trigger handle 32 and a forward brace handle 34. The trigger handle 32 has a power switch 36 mounted therein for operation by one hand of the saw user. The other hand of the saw user is positioned on brace handle 34 which allows the user to further control the saw as it passes through a workpiece.

Trigger handle 32 has a generally hollow housing 38 which is formed in a clamshell fashion by two half sections 39. Housing 38 has a gripping portion 40 which fits within the palm of an operator during operation, and generally extends in an elongated direction along an axis 42, as best shown in FIGS. 2 and 3. Axis 42 is generally at an angle to the plane of base 30 and slopes downwardly in a direction from a forward end of the saw toward a rearward end of the saw. Power switch 36 is received within a generally rectangular mounting section or boss 44 of each of the clamshell halves 39 of housing 38. Switch 36 has a trigger 46 extending through an aperture 48 within housing 38 that allows actuation by the index and middle finger of an operator in a generally upwardly direction such that electrical connections can be made within switch 36 to connect the power supply of the saw with the saw motor resulting in rotation of the blade. Trigger 46 is generally internally biased toward its disengaged or "off" position. Trigger 46 generally is of a solid construction, as shown in FIG. 5, but has a pair of hollow chambers 50 formed adjacent a forward end, which are separated by a locking abutment or ridge 52. As will be more fully explained below, the upper surface 54 of ridge 52 serves as the engaging surface with a lockout mechanism 56, also disposed within housing 38. As will be further explained, the hollowed portions of chamber 50 on each side of ridge 52 act as clearance areas to allow actuation of trigger 46, as is shown in FIG. 6.

Lockout mechanism 56 includes an elongated cylindrical locking shaft 58 and a biasing coil spring 60. Lockout shaft 58, as best shown in FIGS. 3, 5, 6 and 7, includes a locking fin 62 positioned and integrally formed on one end, and an oversized actuating cylinder 64 formed on an opposite end. Cylinder 64 and shaft 58 are rotatably or pivotally received within the clamshell halves 39 of housing 38 via appropriate generally semicircular shaped bosses formed in each housing half 39. In particular, the end of shaft 58 located adjacent fin 62 is received in a pivotally/rotatably supporting boss 66. Still further, the entire actuating cylinder 64 is received in a generally semicircular boss 68. Boss 68 almost completely surrounds cylinder 64 when the clamshell halves 39 of housing 38 are put together, thus allowing rotation of shaft 58 and cylinder 64 about an axis 70 which is generally aligned with and parallel to the axis 42 of gripping portion 40.

Figure 6:
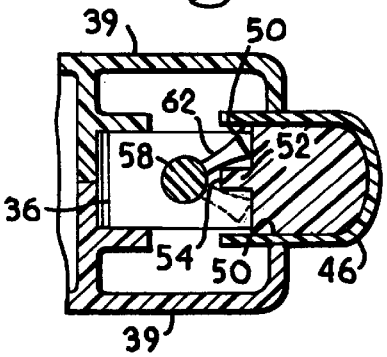
FIG. 6 is a view similar to FIG. 5 showing the lockout fin in its disengaged position and actuation of the power switch, an alternative disengaged position shown in phantom lines.

As best shown in FIGS. 5 and 6, locking fin 62 has a lower surface 72 which engages surface 54 or ridge 52 when trigger 46 is in its locked-out position. Still further, fin 62 is received within either of chambers 50 of trigger 46 to allow actuation of the trigger to its "on" position, as will be more fully described below.

Actuating cylinder 64 has positioned on its peripheral surface 74 actuating levers 76 at diametrically opposed locations. As best shown in FIG. 4, each lever 76 extends through an aperture 78 formed in each of the clamshell halves 39 of housing 38. Apertures 78 are generally rectangular in shape and allow movement of levers 76 therein in both generally upwardly and downwardly rotations, as indicated by the arrows and phantom line locations in FIG. 4. Therefore, rotation of either lever 76 within aperture 78 will result in rotation of shaft 58 and thus fin 62. This rotating action results in mechanism 56 obtaining its disengaged or unlocked position, as will be more fully described below.

Figure 8:
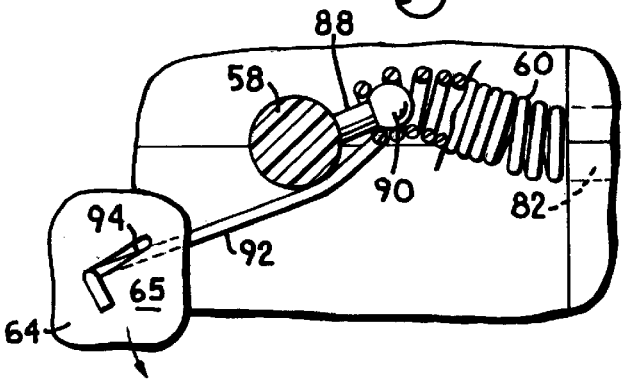
FIG. 8 is a cross-sectional view taken generally along line 8—8 of FIG. 7 and showing the deformation of the coil spring when the lockout mechanism is rotated in one particular direction to its disengaged position to allow actuation of the power switch.
Figure 10:
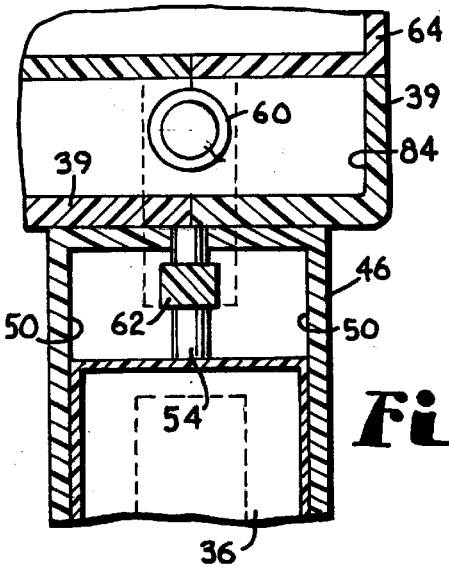
FIG. 10 is a cross-sectional view taken generally along line 10—10 of FIG. 7, and showing the locking fin of the present invention in its engaged position so as to prevent actuation of the power switch.
Figure 9:
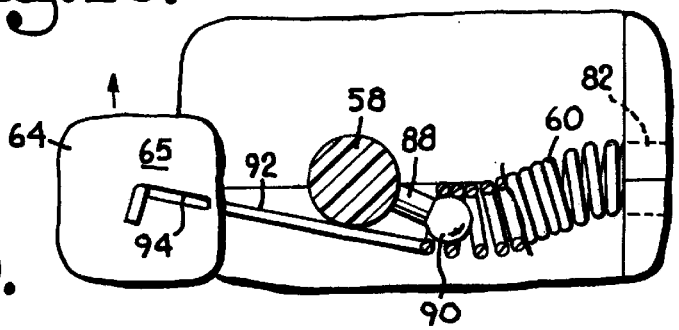
FIG. 9 is a view similar to FIG. 8, but showing the lockout mechanism rotated in a direction opposite to that shown in FIG. 8 with the opposite deformation of the coil spring.

Coil spring 60 is also received within housing 38 via generally semicircular bosses 80 formed in clamshell halves 39, as best shown in FIGS. 3 and 7. In particular, the lower half portion 82 of spring 60 is snugly received in a generally cylindrical chamber formed by bosses 80. However, a suitable chamber 84 is formed in housing 38 which allows the top half 86 of spring 60 to be deformed in a left or right direction with respect to axes 42 and 70, as best shown in FIGS. 8 and 9. Upper half 86 of spring 60 is coupled to shaft 58 via circumferential protrusion 88 having a generally spherical coupling end 90. End 90 is received within the hollow interior of spring 60, as best shown in FIG. 7. Spherical end 90 allows a smooth rotating action of protrusion 88 with respect to spring 60 when shaft 58 is rotated so as to deform spring 60. In addition to protrusion 88, spring 60 has an upwardly extending leg 92 which is received in an aperture 94 formed in an end planar surface 65 of actuating cylinder 64. Leg 92 serves as an additional attachment to shaft 58 and cylinder 64. As is apparent, spring 60, through its protrusion 88 and leg 92, serves to bias fin 62 to its locked position from its disengaged/unlocked positions resulting from rotation of shaft 58 in either direction via lever 76.

With reference to FIGS. 2, 5, 7 and 10, the lockout mechanism 56 is shown in its locked position which will prevent an operator from actuating trigger 46 upwardly to result in rotation of blade 24. More specifically, locking fin 62 of locking shaft 58 engages ridge 52 of trigger 46, as best shown in FIG. 5, and prevents upward movement of trigger 46. Additionally, in this position, spring 60 is in its natural unbiased state and is not exerting any biasing pressure on shaft 58 or actuating cylinder 64. Therefore, in this position if an operator grips portion 40 of housing 38 and attempts to actuate trigger 46 with his or her index and middle finger, such actuation will be prevented so that the saw cannot be turned to its "on" position.

If an operator wishes to position trigger 46 in its depressed or "on" position, the operator must first position his or her thumb on one of the actuating levers 76 extending through the apertures 78 in housing 38. More specifically, an operator can grip portion 40 easily within his or her hand and position the index and middle fingers on trigger 46. Portion 40 can rest easily within the palm of the operator and the thumb of the hand gripping portion 40 can be positioned along the side surface of housing 38 forwardly of the index and middle finger in the natural and stable gripping configuration. The thumb engages the top surface of the lever 76 on the side the thumb is on, and can exert downward pressure on the lever so as to rotate cylinder 64 and shaft 58. This rotation of shaft 58 will result in rotation of locking fin 62, as best shown in FIG. 6, such that fin 62 is no longer positioned directly above ridge 52. With pressure applied via the index and middle fingers of the operator to trigger 46, the trigger can be depressed to its "on" position, and in this position fin 62 will be disposed in one of the chambers 50, as best shown in FIG. 6. After the switch has been depressed, the lever 76 will be in a downwardly sloped orientation (shown in phantom in FIG. 4) such that the thumb can easily slide off of the actuating lever and resume a more normal position along the side of handle housing 38.

With reference to FIG. 8, during a rotation of shaft 58 from its locked to unlocked position, coil spring 60 will be deformed sidewardly. As is apparent, spring 60 will want to regain its natural state from this deformed state, and thus will tend to bias shaft 58 to its locked position. Therefore, during operation of the saw, shaft 58 will remain in an unlocked position, and spring 60 will remain in its deformed position, because fin 62 will be disposed in a one of chambers 50, thus preventing the shaft from rotating to its locked position. However, once an operator releases trigger 46, which is typically biased to its "off" position, ridge 52 will no longer prevent rotation of fin 62, and thus the bias of spring 60 will return shaft 58 and fin 62 to their locked positions. Therefore, if the operator again desires to actuate trigger 46, he or she must first push downwardly on lever 76.

As best shown in FIGS. 4, 6, 8 and 9, an advantage of the present invention is the feature that rotation of the locking mechanism in any direction results in the locking mechanism moving from its locked to unlocked position. This allows levers on either side of housing 38, and thus allows easy accommodation of both left-handed and right-handed saw operators. In particular, levers 76 located on either side of housing 38 provide comfortable positions for either a left-handed or right-handed saw operator's thumbs during the initial cutting operations and easy transition from the initial operations requiring actuation of mechanism 56 to a full grip about handle portion 40. In particular, as the thumb of a user pushes down on lever 76, the top surface of lever 76 becomes slanted downwardly and easily allows the user's thumb to slide off of lever 76 and go to its natural position. As this is done, the bias of the mechanism attempts to return lever 76 to its locked position. Still further, the rotation or orientation of shaft 58 generally along the longitudinal orientation of handle portion 40 allows flexibility, in that an operator can even, if so desired, push upwardly along one of levers 76 which will still result in the mechanism obtaining its disengaged unlocked position. A still further advantage found in the present invention is the location of actuating lever 76 ahead of trigger 46, such as to allow the thumb of an operator to obtain a more natural position and to quickly obtain a gripping position after actuating the mechanism. In prior art mechanisms, it was oftentimes necessary to locate the structure of the lockout mechanism as close as possible to the switch in order to obtain mechanical advantages, or to utilize sliding or camming surfaces. Because of the provision of rotating shaft 58, generally along the axis of the handle, lever 76 can be positioned at any desirable point ahead of the trigger, and all that is necessary is that access or space be available within the handle for the shaft and fin 62. Thus, the provision of shaft 58 rotating generally along the axis of the handle allows flexibility in deciding where to put the actuating levers and biasing structures.

As is apparent, mechanism 56 also provides a very easily assembled, simple lockout mechanism for a power switch. In particular, mechanism 56 can be comprised essentially of two parts. Fin 62, shaft 58, cylinder 64, and levers 76 can all be molded as a one-piece part, which can be easily dropped into the relevant bosses formed in the clamshell structure of housing 38. Coil spring 60 can easily be assembled with such part and also dropped within the relevant bosses of housing 38 during manufacture. It is also a noticeable advantage that spring 60 does not require any precompressing or pretensioning during assembly. Such precompressing or pretensioning of a spring during assembly oftentimes requires certain skill and patience when putting parts together. An additional advantage of the present invention is the sideward deformation of coil spring 60. In particular, it has been found that deforming a coil spring not along its axis, but sidewardly, as shown in FIGS. 8 and 9, allows the spring to have a substantially constant force curve. In particular, once a threshold force is reached, the coil spring will start to deflect outwardly without offering increasing resistance. This is advantageous to the saw user when actuating the lockout mechanism, because lever 76 will not begin to rotate until the threshold force level is reached, and as the lever 76 is rotated, the force the operator is required to apply will not increase. Thus, the provision of the sideward deformation of the coil spring provides for ease and stability in actuating lockout mechanism 56.

Thus, the present lockout mechanism provides an easily assembled simple mechanism which is ergonomically advantageous to an operator and which allows the operator to easily assume the normal gripping orientation as quickly as possible after actuating the lockout mechanism.

From the foregoing, it will be seen that this invention is one well-adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matters herein set forth or shown in the accompanying drawings are to be interpreted as illustrative and not in a limiting sense.

We claim:

1. A power tool comprising:

a housing having a motor disposed therein, the housing including a handle for gripping by a power tool operator and at least two apertures, the apertures opposing one another and being located on opposite sides of the housing;

a switch slidably coupled with the housing and movable between an "off" position and an "on" position for operating the motor;

a locking member at least partially rotatably received in the housing and movable between a rest position, wherein the locking member prevents the switch from being moved from the "off" position, and a wound position, wherein the locking member permits the switch to be moved to the "on" position by the power tool operator; and wherein portions of the locking member are accessible to the power tool operator through both of the apertures, whereby the power tool operator can engage the locking member from either side of the housing and thereby move the locking member to the wound position to permit activation of the power tool.

2. A power tool with an ambidextrous switch lockout mechanism, the tool comprising:

a housing having a motor disposed therein and a handle for gripping by a power tool operator, the handle having a top wall, a bottom wall and first and second side walls, the first and second side walls each having an aperture formed therein;

a switch at least partially slidably received in the bottom wall of the handle and operable by an index finger of the power tool operator when the handle is gripped by the operator;

a locking member at least partially rotatably received in the handle and movable between a rest position, wherein the locking member prevents the switch from being moved from the "off" position, and a tension position, wherein the locking member permits the switch to be moved to the "on" position by the power tool operator;

wherein a portion of the locking member extends outwardly from within the handle through the aperture in the first side wall and is engagable by a thumb of the power tool operator when the handle is gripped by a right hand of the operator; and wherein a different portion of the locking member extends outwardly from within the handle through the aperture in the second side wall and is engagable by a thumb of the power tool operator when the handle is gripped by a left hand of the operator, whereby the operator can move the locking member to the tension position with their thumb whether they operate the power tool with their right hand gripping the handle or their left hand.

* * * * *